United States Patent [19]

Jacobs et al.

[11] Patent Number: 4,970,482

[45] Date of Patent: Nov. 13, 1990

[54] CURRENT LIMITING CIRCUIT BREAKER COMPACT ARC CHUTE CONFIGURATION

[75] Inventors: Linda Y. Jacobs, Barkhamsted; Karen B. Kowalczyk, New Britain; Joseph M. Palmieri, Southington, all of Conn.

[73] Assignee: General Electric Company, New York, N.Y.

[21] Appl. No.: 471,766

[22] Filed: Jan. 29, 1990

[51] Int. Cl.[5] ..... H01H 9/30

[52] U.S. Cl. ..... 335/201; 200/147 R

[58] Field of Search ..... 315/201, 202; 200/144 R, 147 R

[56] References Cited

U.S. PATENT DOCUMENTS

| | | | |
|---|---|---|---|
| 4,218,596 | 8/1980 | Cuasing | 200/144 R |
| 4,375,021 | 2/1983 | Pardini et al. | 200/147 |
| 4,527,027 | 7/1985 | Link et al. | 200/144 R |
| 4,733,032 | 3/1988 | Pardini | 200/144 |
| 4,754,247 | 6/1988 | Raymont et al. | 335/202 |
| 4,885,441 | 12/1989 | Hisatsune et al. | 200/144 R |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A compact circuit breaker utilizing an electronic trip unit for overcurrent determination contains a compact slot motor and a compact arc chute to minimize and control the arc that occurs when the circuit breaker fixed and movable contacts become separated upon intense overcurrent conditions. The fixed contact is arranged on a fixed contact arm that includes an arc runner for rapidly directing the arc into the arc chute. The arc chute includes a keying arrangement which cooperates with slots formed within the circuit breaker case interior sidewalls to orient the arc plates relative to the arc runner.

1 Claim, 3 Drawing Sheets

CURRENT LIMITING CIRCUIT BREAKER COMPACT ARC CHUTE CONFIGURATION

BACKGROUND OF THE INVENTION

An integrated circuit protection unit is defined as a circuit breaker that includes optional accessory protection features. One such integrated circuit protection unit is described in U.S. Pat. No. 4,754,247 which Patent is incorporated herein for reference purposes. The circuit breaker includes an accessory cover which is accessible for field-installation of selected accessory functions. The circuit breaker also includes an electronic trip unit in the form of a printed wire board positioned within a recess formed in the circuit breaker cover.

A current limiting circuit breaker utilizes the electromagnetic repulsion that occurs between the fixed and movable contact arms upon intense short circuit conditions to separate the circuit breaker contacts before the circuit breaker operating mechanism has time to respond. One example of a current limiting circuit breaker is described within U.S. Pat. No. 4,375,021 which Patent is incorporated herein for reference purposes. The arrangement of the slot motor to accelerate the movement of the movable contact arm allows the circuit to be interrupted in the early stages of the current wave form and hence limits the current to a reasonable value. The specially-designed arc chute in the aforementioned Patent rapidly quenches and extinguishes the arc that occurs during the rapid separation of the contacts. The complex design of both the slot motor and arc chute, however, do not readily allow for application within an automated circuit breaker assembly process.

U.S. Pat. No. 4,733,032 describes an electric arc chute wherein the configuration of the arc plates and the composition of the arc chute support material are optimized to rapidly cool and extinguish the arc that occurs upon current limiting circuit interruption. This Patent is incorporated herein for reference purposes and should be reviewed for its description of the arc quenching properties of the specific plastic resin material used within the arc chute support.

When current-limiting is attempted in certain lower-rated industrial molded case circuit breakers, problems occur due to the compact size limitations on the circuit breaker components and the circuit breaker enclosure, per se. It is difficult to contain the intense arc that is generated during the current-limiting circuit interruption within the compact confines of the circuit breaker enclosure without causing damage to the enclosure. It is also difficult to quench and cool the arc because of the size restraints on the circuit breaker components within the enclosure since larger arc chute designs do not readily fit within the confines of the compact circuit breaker enclosure.

U.S. patent application Ser. No. 344,936 filed Apr. 28, 1989 and entitled "Compact Current Limiting Circuit Breaker" describes a compact slot motor as well as a compact arc chute configuration. With such compact arc chute configurations, it is important that the arc that occurs upon contact separation rapidly enters the arc chute for immediate cooling and deionization. A fixed contact arm arrangement that includes an arc runner intermediate the fixed contact and the arc chute directs the arc into the bottom surface of the arc chute. The arc chute configuration employs U-shaped arc plates that are designed to quench and cool the arc that occurs upon contact separation and are oriented at an angle relative to the plane of the circuit breaker enclosure to provide maximum contact between the arc and the surface of the arc plates as well as to direct the flow of the generated arc gases. One purpose of this instant invention accordingly, is to provide means for orienting the arc plates relative to the circuit breaker contacts to insure proper orientation between the U-shaped arc plates and the circuit breaker contacts.

SUMMARY OF THE INVENTION

A compact circuit breaker employing a slot motor to rapidly separate the circuit breaker contacts further includes a compact arc chute configuration for rapidly cooling and deionizing the arc that occurs upon contact separation. A keying arrangement between the arc plates and the sidewalls of the arc chute automatically orients the arc plates within the arc chute while cooperation between bars arranged on the arc chute outer surface and slots formed within the circuit breaker case further orients the position of the arc plates relative to the circuit breaker contacts.

DESCRIPTION OF THE PREFERRED EMBODIMENT

Figure 1:
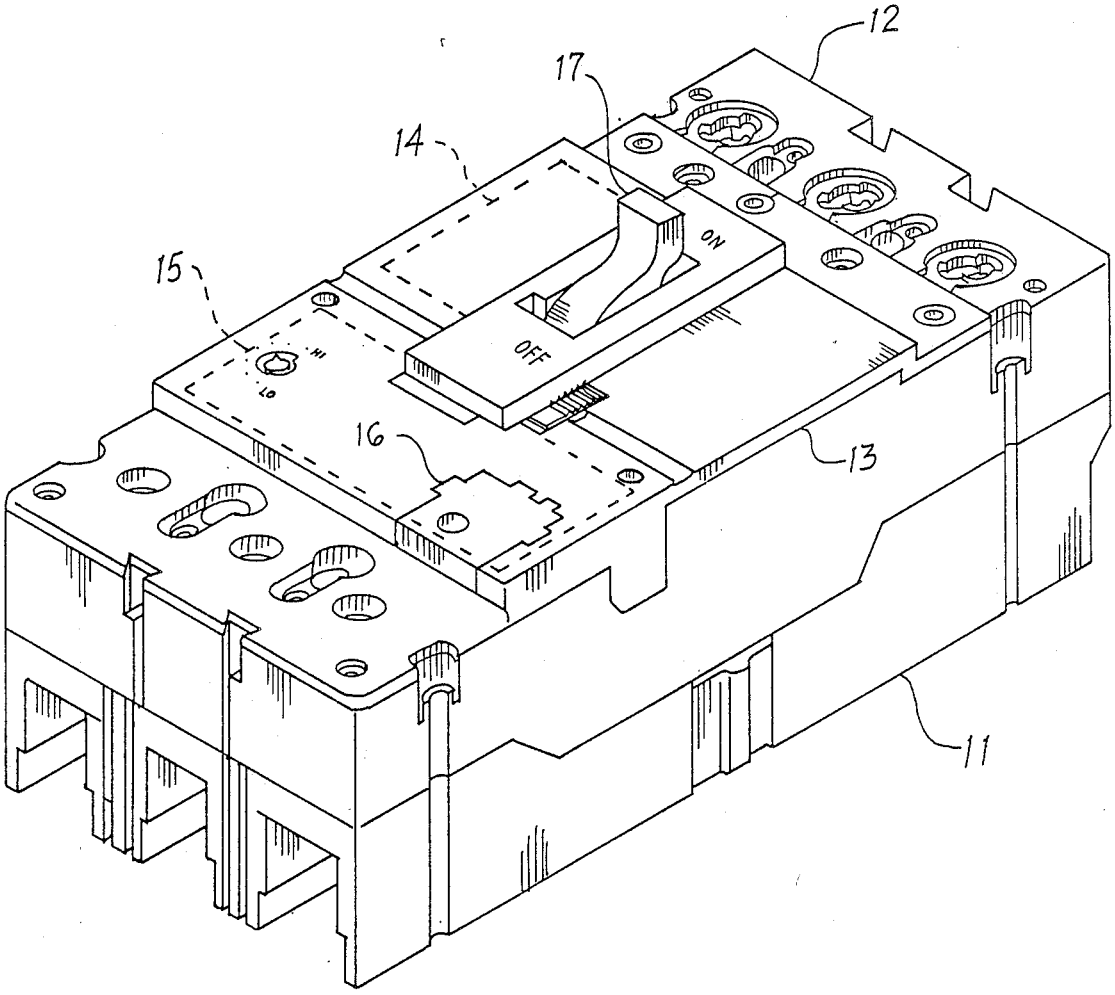
FIG. 1 is a top perspective view of a circuit breaker containing the compact arc chute according to the invention.

An integrated circuit breaker 10 as shown in FIG. 1, consists of a case 11 to which a circuit breaker cover 12 is attached. The circuit breaker cover in turn is fitted with an accessory cover 13 for providing access to the trip actuator 14 and the trip unit 15 that are contained within the circuit breaker cover without interfering with the integrity of the circuit breaker operating components that are contained within the case 11. A rating plug 16 positioned within the accessory cover allows a standard-sized circuit breaker to be utilized over a wide range of ampere ratings by selecting the proper rating plug. The circuit breaker operating handle 17 allows for manual intervention for turning the circuit breaker contacts that are contained within the case to their ON and OFF positions.

Figure 2:
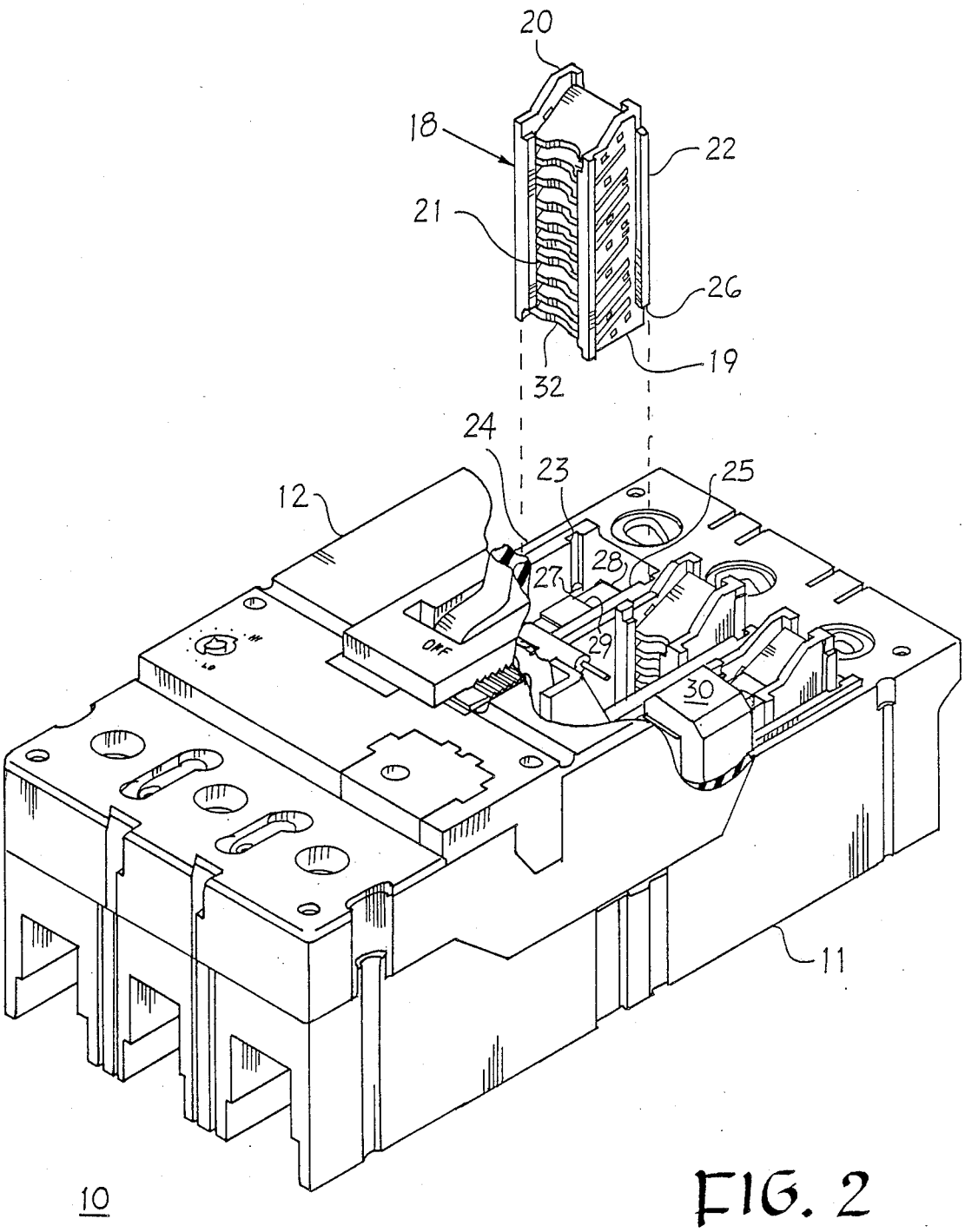
FIG. 2 is a top perspective view of the circuit breaker of FIG. 1 with a part of the cover removed to depict the circuit breaker arc chute configuration according to the invention.

The circuit breaker 10 is depicted in FIG. 2 with part of the cover 12 removed to depict the slot motor 30 and the contact strap 28 with the fixed contact 29 attached thereto. As described in the aforementioned U.S. patent application Ser. No. 344,936, a compact arc chute 18 is imposed between the slot motor and the contact strap to deionize and cool the arc that occurs upon separation of the circuit breaker contacts. The arc chute consists of a pair of opposing sidewalls 19, 20 with a plurality of arc plates 21 supported therebetween. Each of the sidewalls has a post 22 extending vertically along each sidewall and defines a bottom portion 26. Upon insertion of the arc chute within the circuit breaker case 11, the posts 22 are received within opposing slots 23 formed in the outer wall 24 and inner wall 25 of the circuit breaker case. The bottom 26 of the post 22 stops against a step 27 formed within the bottom of the slot 23. Although only one such post 22 on sidewall 19 is visible in FIG. 2, an opposing post is formed on the opposite sidewall 20. The capture of the posts within the slots insures that the arc chute 18 will face in the direction indicated in FIG. 2 with the curved edges 32 on each of the arc plates facing toward the slot motor 30.

Figure 3:
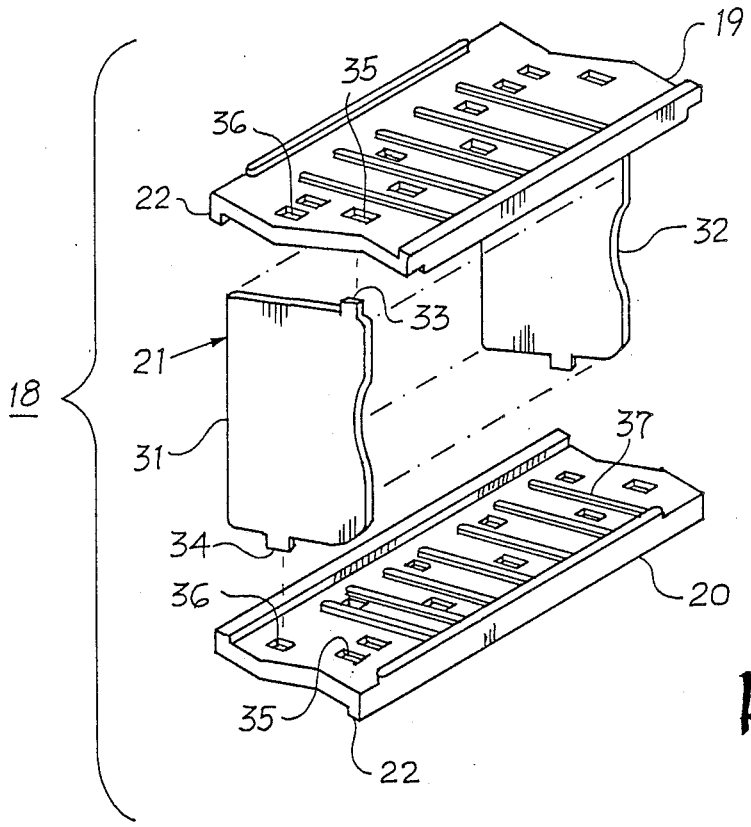
FIG. 3 is a front perspective view of the arc chute of FIG. 2 with the arc chute side plates in isometric projection from the arc plates.

The automatic assembly of the sidewalls 19, 20, is best seen by now referring to the arc chute 18 depicted in FIG. 3 prior to assembly wherein it can be noted that sidewall 19 is a mirror image of sidewall 20 in that they are identical pieces opposedly oriented to each other. One sidewall design accordingly can be used to perform both sidewall functions upon proper orientation. The sidewalls 19, 20 include a plurality of parallel-arranged ribs 37 integrally-formed with and upstanding from the sidewalls and first and second rows of apertures 35, 36 formed therethrough. The upstanding ribs 37 serve to mechanically and electrically strengthen the sidewalls. The top tabs 33 and the bottom tabs 34 are offset from each other such that insertion of the bottom tabs 34 within the associated apertures 36 in sidewall 20 automatically aligns the top tabs 33 within the corresponding apertures 35 formed within the opposite sidewall 19 as well as to provide increased dielectric strength between the tabs. The automatic orientation between the top and bottom tabs, insures that the curved edges 32 on each arc plate 21 will all face in one direction and that the corresponding flat edges 31 will all face in an opposite direction therefrom. The alignment of the top tabs 33 within corresponding apertures 35 and the alignment of the bottom tabs 34 within corresponding apertures 36 also insures that the post 22 on sidewall 19, will face outwardly from the arc chute 18 while the post 22 on sidewall 20 will also face outwardly. The outward positioning of the posts 22 further insures alignment of the arc chute 18 relative to the slots 23 formed within the circuit breaker case 11 described earlier with reference to FIG. 2.

Figure 4:
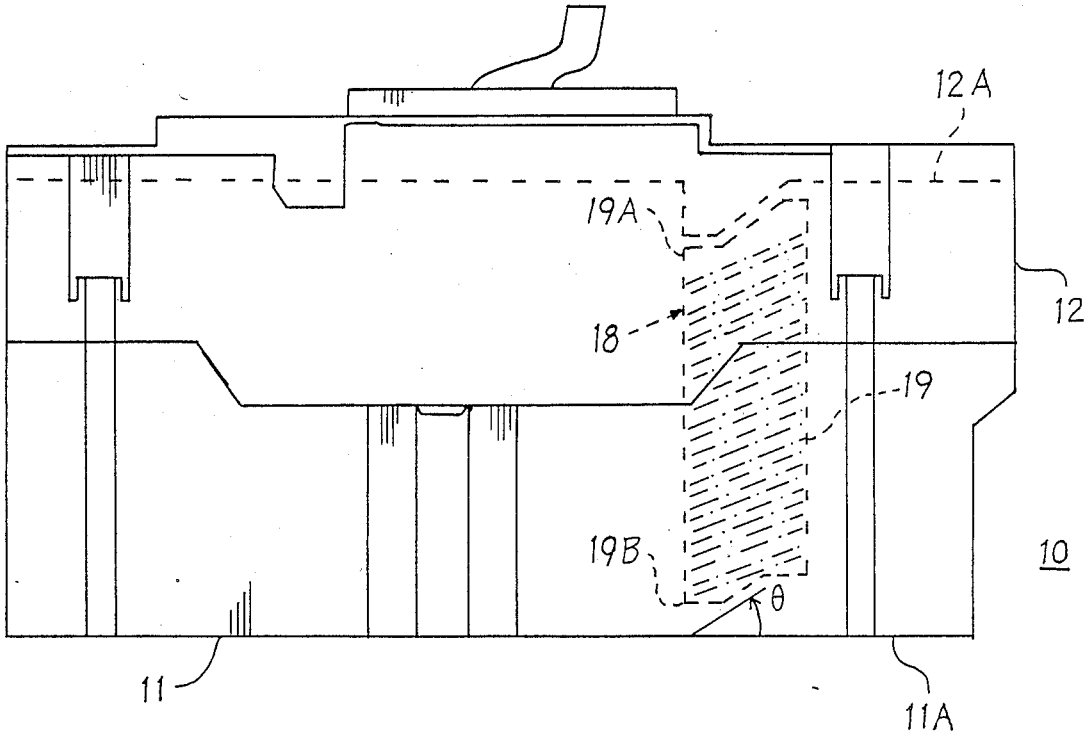
FIG. 4 is a side view of the circuit breaker of FIG. 1 prior to attachment between the cover and the case.

Besides automatic alignment between the top and bottom tabs of the arc plates and the corresponding opposing sidewalls, as seen earlier with reference to FIG. 3 and the orientation between the arc chute and the circuit breaker case as seen earlier with reference to FIG. 2, the arc chute is also keyed with respect to the circuit breaker cover 12 as best seen by referring now to the circuit breaker 10 depicted in FIG. 4 with the cover 12 attached to the case 11 and with the arc chute 18 assembled within the circuit case and cover. To insure maximum contact between the arc gases that are generated when the circuit breaker contacts become separated upon overcurrent conditions, the arc plates are oriented at an angle $\theta$ with respect to the bottom 11A of the circuit breaker case 11. The top 19A and bottom 19B of the sidewall 19 and the top of the opposing sidewall although not shown, is configured at the same angle. The inside surface 12A of the cover 12 immediately adjacent the arc chute is configured to the same angle such that when an attempt is made to position the arc chute within the case with the arc plates facing in the opposite direction from that shown in FIG. 4, the interior surface of the cover will interfere with the top of the arc chute and thereby prevent the cover from being attached to the case.

A compact arc chute arrangement has herein been described wherein one sidewall design is multi-functionally used to support both sides of the arc chute. The arrangement of the arc plate tabs within corresponding holes formed in the sidewalls insures proper alignment with respect to the edges of the arc plates. Posts integrally-formed on the outside surfaces of the sidewalls orient the arc chute within the circuit breaker case with respect to the circuit breaker contacts contained therein. Additionally, the inclination formed at a predetermined angle on the interior surface of the circuit breaker cover and the inclination of the top of the arc chute at the same angle insures proper orientation with respect to the arc plates before attachment can be made between the circuit breaker cover and the circuit breaker case.

Having thus described our invention, what we claim as new and desire to secure by Letters Patent is:

1. A current limiting circuit interrupter comprising:

a molded plastic case and cover;

a pair of separable contacts and an operating mechanism within said case arranged for interrupting circuit current through a protected electric power distribution circuit upon occurrence of an overcurrent condition;

a slot motor within said case to separate said contacts prior to actuation of said operating mechanism;

an arc chute within said case, said arc chute comprising a pair of sidewalls supporting a plurality of arc plates having arcuate edges receiving an electric arc formed upon separation of said contacts, each of said sidewalls including positioning means integrally-formed on an outer surface, said positioning means being received within slots formed within exterior and interior walls of said case, to thereby orient said arcuate edges toward said contacts, a top part and a bottom part of said sidewalls being arranged at a predetermined angle relative to said bottom, an interior surface of said cover being inclined at a predetermined angle to interfere with said top part and thereby prevent attachment between said cover and said case when said arc chute is inserted within said case with said arcuate edges oriented away from said contacts.

* * * * *